United States Patent [19]

Sweet

[11] Patent Number: 4,934,007

[45] Date of Patent: Jun. 19, 1990

[54] DECK TILTING DEVICE

[75] Inventor: Edmund G. F. Sweet, Ontario, Canada

[73] Assignee: Metal Craft Manufacturing Ltd., Beamsville, Canada

[21] Appl. No.: 382,357

[22] Filed: Jul. 20, 1989

[51] Int. Cl.[5] ..... A61G 7/00

[52] U.S. Cl. ..... 5/62; 5/64

[58] Field of Search ..... 5/11, 62, 65

[56] References Cited

U.S. PATENT DOCUMENTS

| | | | |
|---|---|---|---|
| 1,037,419 | 9/1912 | Bosanko | 5/64 |
| 2,687,536 | 8/1954 | Miller | 5/62 |
| 3,149,348 | 9/1964 | Hillenbrand et al. | 5/63 |
| 3,222,693 | 12/1965 | Pruim et al. | 5/62 X |
| 4,658,450 | 4/1987 | Thompson | 5/62 X |

*Primary Examiner*—Michael F. Trettel

*Attorney, Agent, or Firm*—Rogers, Bereskin & Parr

[57] ABSTRACT

A deck tilting device includes a deck, a support frame and a deck tilting mechanism for selectively raising respective ends of the deck. The deck tilting mechanism comprises an operating member and two linkages. The operating member is mounted on the frame below the deck and is longitudinally movable relative to the frame. One of the linkages is located between the operating member and each end of the deck, each linkage including a connecting member pivotally mounted on the support frame and forming a pivotal link between the operating member and the deck. Longitudinal movement of the operating member towards one end of the deck results in corresponding movement of the respective connecting member and raising of the respective end of the deck.

15 Claims, 4 Drawing Sheets

DECK TILTING DEVICE

This invention relates to a deck tilting device, particularly a deck tilting device for use in hospital cots.

BACKGROUND OF THE INVENTION

In hospitals, patients often spend the majority, if not all, of their time in bed. Thus, a bed is not only used for sleeping, but a patient will also likely receive treatment while in bed. This has led to the development of a variety of adjustable beds, which may be tilted or inclined or which are provided with a sectioned deck to allow the bed, or at least the mattress, to be configured into a more convenient form for treating the patient or simply to provide a more comfortable position for sitting. Examples of such beds are described in U.S. Pat. Nos. 3,231,904 to Shulkin, 3,277,501 to Frisz et al, 3,478,372 to Benoit et al and 3,611,452 to Turko et al. Related mechanisms are also disclosed in U.S. Pat. Nos. 1,866,397 to Clewley and 3,243,825 to Tabbert.

For children's cots, a sectioned deck is generally not required. However, tilting of the deck may still be required for the treatment of various conditions and the alleviation of symptoms, for example: asthmatic children often find breathing easier when their upper body is raised; and children with cardiovascular conditions are preferably positioned with their upper body lowered.

In addition to possessing the capability to tilt, the deck of a cot must also be capable of withstanding a child jumping or bouncing on the mattress without causing collapse of the deck. This has been one of the problems associated with the conventional method of inclining a child's cot deck, in which one end of the deck is bodily lifted and rested on simple catches on the end frame of the bed.

SUMMARY OF THE INVENTION

According to one aspect of the present invention there is provided a deck tilting device including a deck, a support frame and deck tilting means for selectively raising the respective ends of the deck. The deck tilting means comprises an operating member and two linkages. The operating member is mounted on the frame below the deck and is longitudinally movable relative to the frame. A linkage is located between the operating member and each end of the deck, each linkage comprising a connecting member pivotally mounted on the support frame and forming a pivotal link between the operating member and the respective end of the deck. Movement of the operating member towards one end of the deck results in corresponding movement of the respective connecting member and raising of the respective end of the deck.

Each connecting member may be in the form of a bell crank lever with a first link pivotally connected between one arm of the connecting member and the operating member and a second link pivotally connected between the other arm of the connecting member and the respective end of the deck.

Movement of the operating member may be achieved by rotation of an adjustable screw rotatably mounted on the frame. Rotation of the screw in one direction causes the operating member to move in a first direction to abut one of the first links and thus raise the respective end of the deck. Rotation of the adjusting screw in the opposite direction causes the operating member to abut and move the other of the first links and raise the other end of the deck.

BRIEF DESCRIPTION OF THE DRAWINGS

This and other aspects of the present invention will now be described, by way of example, with reference to the accompanying drawings in which.

DETAILED DESCRIPTION OF PREFERRED EMBODIMENT

Figure 1:
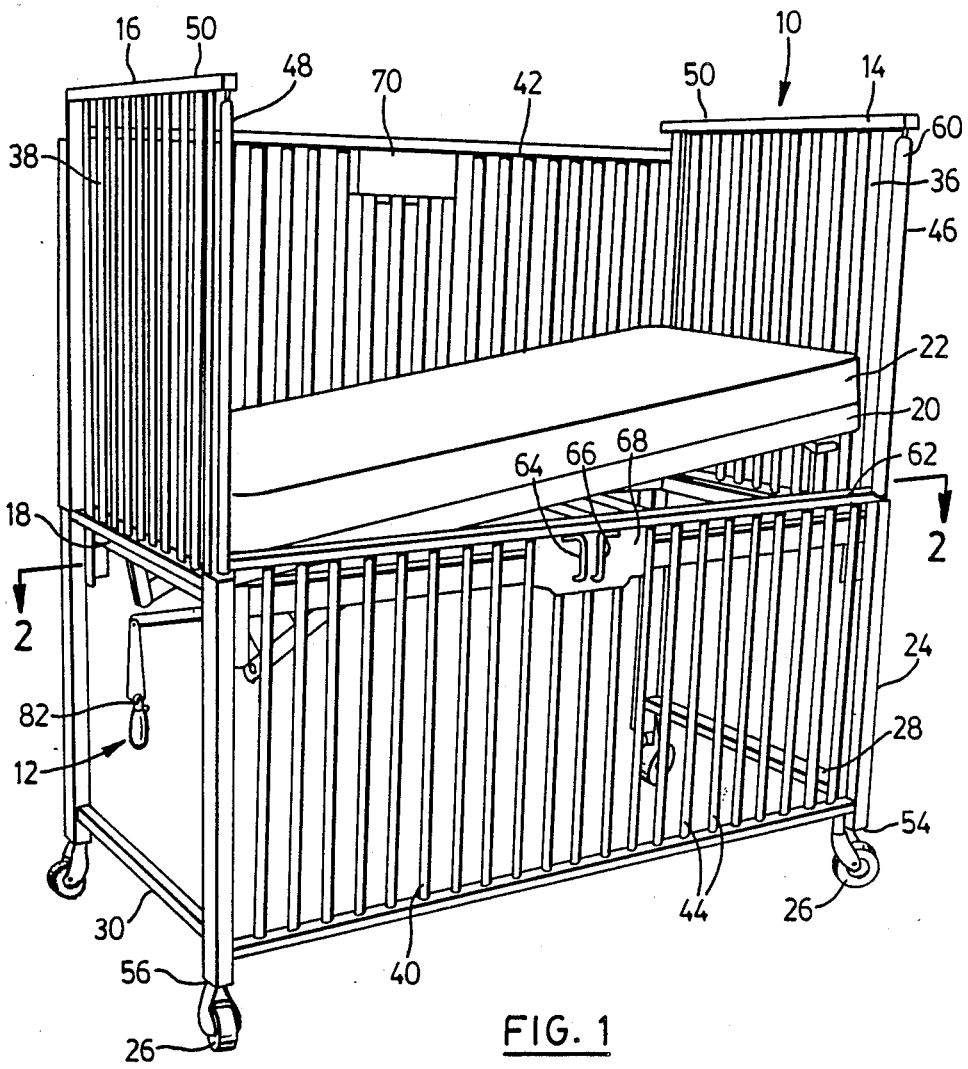
FIG. 1 is a perspective view of a hospital cot incorporating a deck tilting device in accordance with a preferred embodiment of the present invention.

Reference is first made to FIG. 1 of the drawings, which shows a hospital cot 10 provided with a deck tilting device 12 in accordance with a preferred embodiment of the present invention. The cot 10 will be described first, followed by a detailed description of the deck tilting device 12.

The cot 10 has two end frames 14, 16 and a support frame 18 for a bed deck 20, which in turn supports a mattress 22. The lower portions of the end frames 14, 16 provide legs 24, each leg 24 having a ground engaging, lockable castor wheel 26. Cross members 28, 30 extend between the legs of the respective end frames 14, 16 to provide additional rigidity.

Cot end walls 36, 38, formed of upper portions of the end frames, together with cot side walls 40, 42, include spaced vertical bars 44 to provide a "cage" around the bed deck 20. The end walls 36, 38 are fixed in position, though the side walls 40, 42 are mounted on vertical slide members 46,48 which extend over the height of the cot 10 between extensions of top members 50 of the end frames 14, 16 and brackets 54, 56 provided at the base of the legs 24. The side walls 40, 42 are retained in the raised position by retractable pins (not shown) which engage apertures 60 in the slide members 46, 48. The retractable pins are formed on the end of rods mounted in top members 62 of the respective side walls 40, 42, and are biased outwardly to a slide member engaging position by compression springs, and operated by means of sliding handles 64, 66. To prevent a child in the cot accessing the handles 64, 66, guard plates 68, 70 are provided on the side walls 40, 42 to the inside of the handles.

The deck 20 of the cot 10 may lie in a horizontal position, or may be raised at one end, as is seen in FIG. 1, by rotation of a crank handle 82 below the deck 20 at the foot of the cot. The crank handle 82 forms part of the deck tilting device 12 which will now be described with reference to FIGS. 2, 3, and 4 of the drawings. The device 12 operates by raising one end of the deck from the level position in which the deck 20 rests on the rectangular support frame 18. Briefly stated, the device 12 converts rotation of a screw 84, achieved by means of crank handle 82, to movement along a longitudinal axis which, by use of a system of links and levers, causes vertical movement of an appropriate end of the deck 20.

Figure 2:
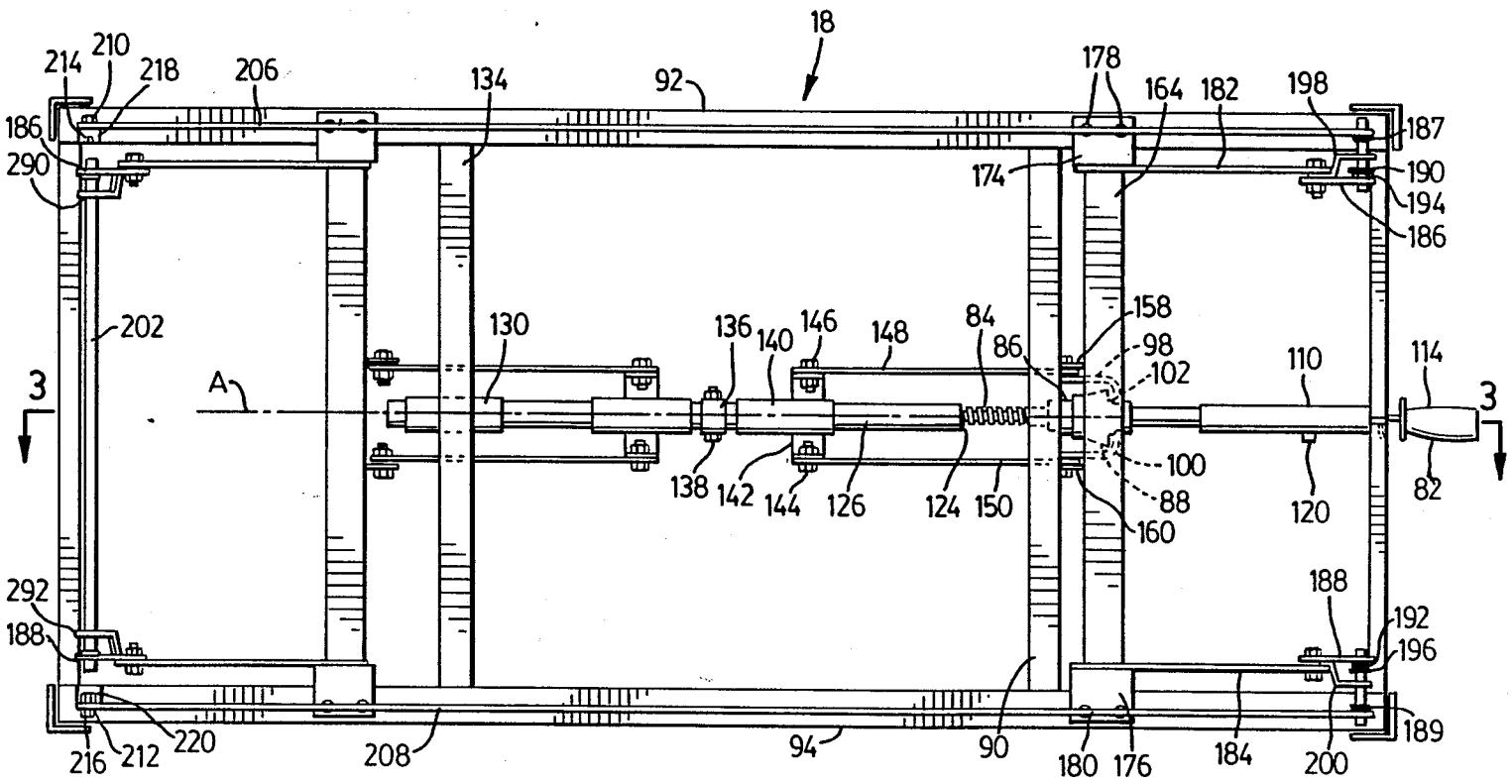
FIG. 2 is a sectional on line 2—2 of FIG. 1 and shows the deck tilting device in plan view.
Figure 3:
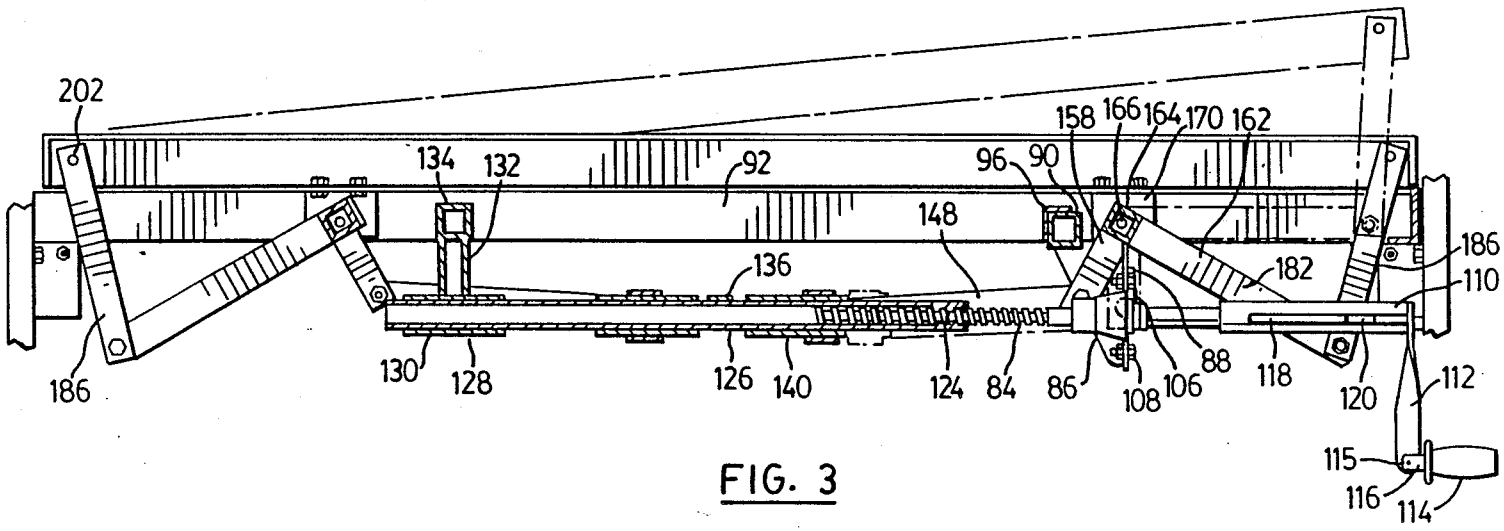
FIG. 3 is a section view on line 3—3 of FIG. 2, showing the deck in a level position in solid line, and also showing the foot of the deck in a raised position, in ghost outline.

If reference is made to FIGS. 2 and 3, it will be seen that the screw 84 is mounted towards the foot of the support frame 18 in a tiltable bearing 86, itself mounted on a bracket 88 which depends from a cross member 90 extending between side members 92, 94 of the support frame 18. The cross member is formed of tubular square section and includes a reinforcing angle member 96 welded to a side and upper face of the member 90. The bearing mounting bracket 88 is u-shaped, when viewed from above as in FIG. 2, and has two triangular-shaped sides 98, 100 and a rectangular cross piece 102 having a centrally located aperture to receive the screw 84 and two smaller apertures to receive bolts 106, 108 which secure the bearing 86 to the bracket 88. The sides 98, 100 of the bracket 88 are welded to the lower side of the cross member 90.

As mentioned above, rotation of the screw 84 is achieved by means of the crank handle 82. The portion of the screw 84 within the bearing 88 has a smooth outer surface and extends from the bearing 88 towards the foot of the support frame 18. The crank handle 82 includes a cylindrical sleeve 110, and a lever member 112 which extends normally from the end of the sleeve 110 and is twisted through 90° to provide a suitable location for a pivotal mounting for a handle grip 114. The lever member 112 has a pivot pin at its free end which engages a clevis 116 which extends from the grip 114 and allows the grip 114 to be pivoted from a vertical storage position (see FIG. 1) to a horizontal operating position (see FIG. 2). The sleeve 110 is provided with a longitudinal slot 118 which accommodates a pin 120 extending radially from the smooth portion of the screw. Thus, the crank handle may be moved between a storage position, in which it lies beneath the support frame and deck, to an in-use position, in which the end of the sleeve 110 extends beyond the foot of the cot, allowing 360° rotation of the lever member 112.

The opposite, or head end of the screw 84 extends beyond the bearing 86 to engage an internally-threaded portion 124 provided in the end of a sleeve 126 which forms a part of an operating member which controls the raising and lowering of the bed deck 20. The sleeve 126 is square in cross section and extends between the screw 84 and a mounting collar 128 located towards the head of the cot. The collar 128 is of a square section and is welded to the end of a further square section tube 132 which extends downwards from a square section cross member 134 extending between the side member 92, 94 of the support frame 18.

Rotation of the screw 84 causes movement of the sleeve 126 along a central longitudinal axis A of the frame 18. This movement is transferred to a system of connecting members and links by means of an operating member in the form of a stop 136 secured to an intermediate portion of the sleeve 126. The stop 136 is in the form of an inverted U and is secured to the sleeve by means of a nut and bolt arrangement 138, the bolt passing through corresponding holes in the arms of the stop and the sleeve.

Movement of the sleeve 126, and thus of the stop 136, towards the head of the cot results in raising the head of the deck 20, while movement of the stop 136 towards the foot of the cot causes raising of the foot of the deck 20. The linkages between the stop 136 and the head and foot of the deck 20 are substantially similar, and the linkage for raising the foot of the deck 20 will be described as representative of both linkages.

To raise the foot of the deck 20, the screw 84 is rotated by means of the crank handle 82 to move the sleeve 126 and stop 136 towards the foot of the cot, such that the stop abuts a square-sectioned collar 140 slidably mounted on the sleeve 126. A U-shaped cross bracket 142 is welded to a lower side of the collar 140 and the upturned ends of the bracket 142 are drilled to receive bolt arrangements 144, 146 which act as pivot points for a first pair of elongated links 148, 150. Each bolt arrangement comprises a tubular spacer which is slipped over the bolt, a plastic washer positioned between the bracket 142 and the link 148 and a securing lock nut. A similar arrangement is used for the majority of the hinged portions of the device.

The links 148, 150 extend from the bracket 142 along each side of the sleeve 126 and bearing 86 to pivotally connect with the short arms 158, 160 of a connecting member in the form of a bell crank lever 162. The arm 158, 160 extend upwardly to a length of square-section tubing 164 which defines the pivot axis of the lever 162. Pins 166 (only one shown) extend from the ends of the tubing 164 through respective holes provided in the lower arms 170 (only one shown) of inverted L-shaped brackets 174, 176 which are secured to the respective side member 92, 94 of the support frame 18 by means of pair of bolts 178, 180.

The second arms 182, 184 of the bell crank levers extend, perpendicular to the first arms 170, 172, from the ends of the tubing 164. The second arms are longer than the first arms and are pivotally connected to a second pair of links 186, 188 which extend upwardly from the ends of the arms 182, 184 to the head of the deck 20. The links 186, 188 are pivotally connected to the deck 20 by means of short pins 187, 189 which extend through the ends of the links 186, 188 and the lower arms of L-shaped brackets 190, 192 welded to the underside of the deck 20. The pins are held in position by spring clips 194, 196 located on the inside of the links 186, 188. To provide additional stabilization for the links 186, 188, angled brackets 198, 200 are welded to the ends of the links and have end portions parallel to and spaced outwardly from the end of the corresponding links and are drilled to provide a further bearing point between the links and the rods.

Figure 4:
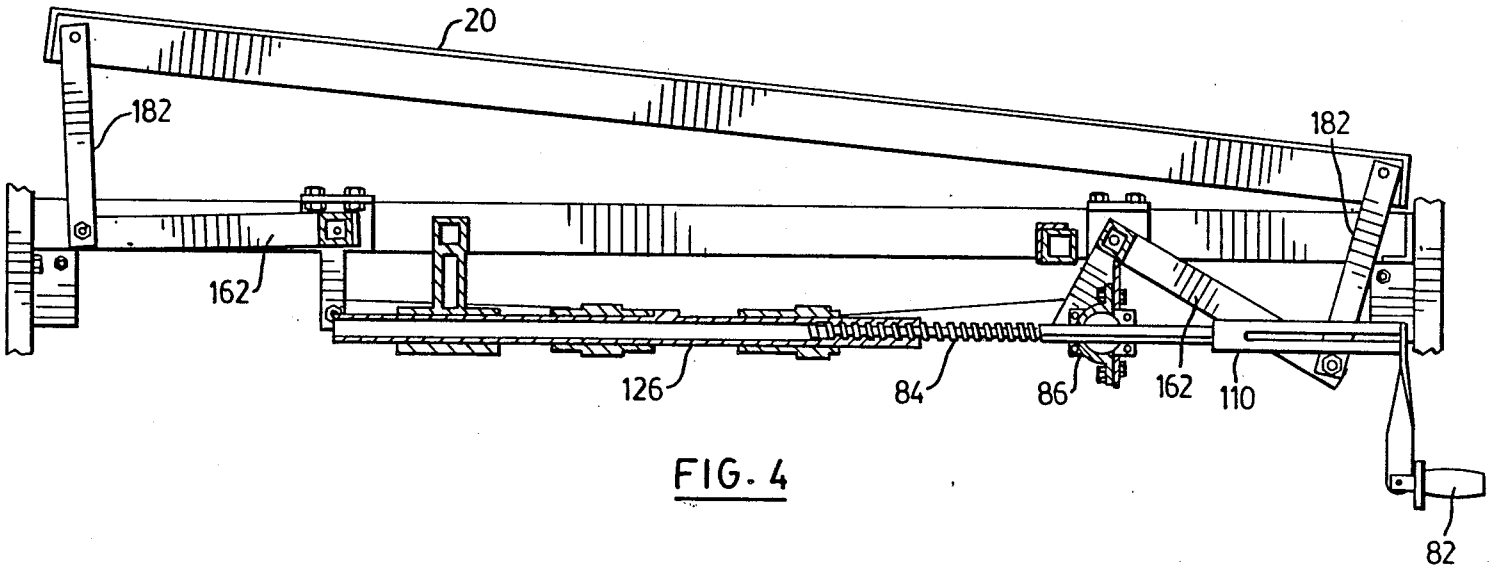
FIG. 4 is a sectional view corresponding to FIG. 3 but showing the head of the deck in a raised position.

Thus, it will be seen that rotation of the screw 84 by means of the crank handle 82 will cause the sleeve 126 and stop 136 to move towards the foot of the bed, thus bearing on the collar 140 to cause rotation of the lever 162 and thus raising of the foot of the deck 20 to the position shown in ghosted outline in FIG. 3. Rotation of the screw in the opposite direction will cause the stop 136 to bear against the other collar resulting in raising of the head of the deck, as shown in FIG. 4.

As was mentioned above, the linkage assembly at the head of the cot is largely similar to the linkage assembly for the foot of the cot, though there are a number of differences at the pivotal connection between the respective second links and the foot of the deck 20. Accordingly, common features of the head linkage will not be described in any great detail.

The pivotal connection between the second links 186, 188 and the frame is achieved through a rod 202, which extends across the frame. It will also be noted that the stabilizing brackets 290, 292 on the ends of the second links 186, 188 are located on the inside of the links. The difference in the arrangements is to permit the accommodation of stabilizer bars 206, 208 which extend between the pins 187, 189 at the foot of the frame and pivotal connections on the head of the frame, at 214 and 216. When the head of the deck 20 is raised, the pins 187, 189 act as the pivot axis around which the deck rotates, and when the foot of the deck is raised, the bolts 210, 212 to which the bars 206, 208 are attached to the support frame 18 provide a pivot axis. The bolts 210, 212 extend through the upper arms of angled brackets 218, 220 mounted on the upper face of the frame side members.

Thus, it will be seen that the deck tilting device described above provides a relatively simple means for selectively raising and lowering the respective ends of a cot deck. Though the device has been illustrated and described with particular reference to a cot, it will be clear to those skilled in the art that the device could be used in other applications, and could be modified or improved within the scope of the present invention.

We claim:

1. A deck tilting device including: a deck having first and second ends and first and second sides; a support frame; and deck tilting means for selectively raising the ends of the deck, the deck tilting means comprising:

an adjusting screw rotatably mounted to the support frame below the deck and extending longitudinally of the support frame;

an operating member having a threaded first end portion for engaging the adjusting screw, a second end portion slidably mounted to the support frame and an intermediate stop; and two link means, one between the intermediate stop and one of the first and second ends of the deck, each link means comprising:

first and second links and a connecting member pivotally mounted on the support frame, the first link being pivotally mounted between the operating member and the connecting member, and the second link being pivotally connected between the connecting member and one of the first and second ends of the deck, the connecting member being in the form of a bell crank lever having a first arm pivotally connected to the first link and a second arm pivotally connected to the second link, rotation of the adjusting screw in one direction resulting in movement of the operating member towards one of the first and second ends of the deck and the intermediate stop acting on one of the link means, resulting in corresponding movement the respective first link, connecting member and second link, and raising of the said one of the first and second ends of the deck, rotation of the adjusting screw in the other direction resulting in raising of the other of the first and second ends of the deck.

2. The deck tilting device of claim 1 and further comprising two sliding collars, each sliding collar pivotally connected to a respective first link and slidably mounted on the operating member.

3. The deck tilting device of claim 2, wherein the adjusting screw is provided with a crank handle for use in rotating the screw.

4. The deck tilting device of claim 3, wherein the crank handle is slidably mounted relative to the adjusting screw and is movable from a storage position beneath the deck to an operating position beyond an end of the deck.

5. The deck tilting device of claim 3, wherein two pairs of first links and two pairs of second links are provided and each connecting member is connected to a respective pair of first links and a respective pair of second links, one of each first links and second links located on each side of the operating member.

6. The deck tilting device of claim 5, wherein the pairs of first links are located adjacent to the operating member near a central longitudinal axis of the deck and the second links are located adjacent to respective sides of the deck.

7. The deck tilting device of claim 6, wherein each connecting member includes a cross member extending between side portions of the support frame, one second arm extending from each end of the cross member.

8. The deck tilting device of claim 7, wherein the support frame has first and second ends and first and second sides and a stabilizer member is provided on each side of the support frame and each stabilizer member is pivotally connected between one of the first and second ends of the support frame and the other of the first and second ends of the deck.

9. A deck tilting device including: a deck having first and second ends; a support frame; and deck tilting means for raising the first end of the deck, the second end of the deck being pivotally mounted to the support frame, the deck tilting means comprising:

an adjusting screw rotatably mounted to the support frame below the deck and extending longitudinally of the support frame;

an operating member having a threaded first end portion for engaging the adjusting screw, a second end portion slidably mounted to the support frame and an intermediate stop; and link means between the intermediate stop and the first end of the deck, the link means comprising:

first and second links and a connecting member pivotally mounted to the support frame, the first link being pivotally mounted between the operating member and the connecting member, and the second link being pivotally connected between the connecting member and the first end of the deck, the connecting member being in the form of a bell crank lever having a first arm pivotally connected to the first link and a second arm pivotally connected to the second link, rotation of the adjusting screw resulting in movement of the operating member towards the first end of the deck and the intermediate stop acting on the link means, resulting in corresponding movement of the first link, connecting member and second link, and raising of the first end of the deck.

10. The deck tilting device of claim 9 and further comprising a sliding collar pivotally connected to the first link and slidably mounted on the operating member.

11. The deck tilting device of claim 10, wherein the adjusting screw is provided with a crank handle for use in rotating the screw.

12. The deck tilting device of claim 11, wherein the crank handle is slidably mounted relative to the adjusting screw and is movable from a storage position beneath the deck to an operating position beyond an end of the deck.

13. The deck tilting device of claim 11, wherein a pair of first links and a pair of second links are provided and the connecting member is connected to the pair of first links and the pair of second links, one of each of the first links and second links being located on each side of the operating member.

14. The deck tilting device of claim 13, wherein the first links are located adjacent to the operating member near a central longitudinal axis of the deck and the second links are located adjacent to respective sides of the deck.

15. The deck tilting device of claim 14, wherein the connecting member includes a cross member extending between side portions of the support frame, one second arm extending from each end of the cross member.

* * * * *